United States Patent [19]

Wiggs et al.

[11] Patent Number: 4,521,204

[45] Date of Patent: Jun. 4, 1985

[54] REMOTELY-CONTROLLED TOY VEHICLE

[76] Inventors: Christopher C. Wiggs, 64 Goldborough Crescent, Chingford, London E4; Christopher J. C. Taylor, 1017 Latchmere Rd., London, SW. 11, both of England

[21] Appl. No.: 604,107

[22] Filed: Apr. 26, 1984

[30] Foreign Application Priority Data

Apr. 29, 1983 [GB] United Kingdom ..... 8311768

[51] Int. Cl.[3] ..... A63H 13/00

[52] U.S. Cl. ..... 446/198; 446/279; 446/197

[58] Field of Search ..... 446/197, 198, 199, 180, 446/280, 279, 286, 288, 454, 437, 460, 468

[56] References Cited

U.S. PATENT DOCUMENTS

| | | | |
|---|---|---|---|
| 3,513,658 | 5/1970 | Okuma | 446/197 X |
| 3,555,726 | 1/1971 | Okuma | 446/197 |
| 3,581,435 | 6/1971 | Wingrove | 446/279 |

FOREIGN PATENT DOCUMENTS

| | | |
|---|---|---|
| 1589327 | 4/1970 | France . |
| 123422 | 2/1919 | United Kingdom . |

*Primary Examiner*—Mickey Yu
*Attorney, Agent, or Firm*—Michael Ebert

[57] ABSTRACT

A remotely-controlled toy vehicle having a steering mechanism and driven by a dc motor selectively connected to a battery by a multi-position switch in a polarity which causes forward or reverse movement. Remote control is effected by a handset having first and second master diaphragm chambers linked through a flexible pneumatic line to first and second slave diaphragm chambers in the vehicle, one slave being operatively coupled to the steering mechanism and the other to the motor control switch. The handset is provided with a torsion bar having a handle, the bar being both swingable from side to side and also being rotatable. The bar is so coupled to the diaphragms of the master chambers whereby when the player swings the bar toward the left or right, this movement is pneumatically transmitted to the steering mechanism of the vehicle to cause the vehicle to turn toward the left or right. When the player rotates the bar clockwise or counterclockwise, this movement is pneumatically transmitted to the switch to cause the vehicle to travel in the forward or reverse direction.

6 Claims, 8 Drawing Figures

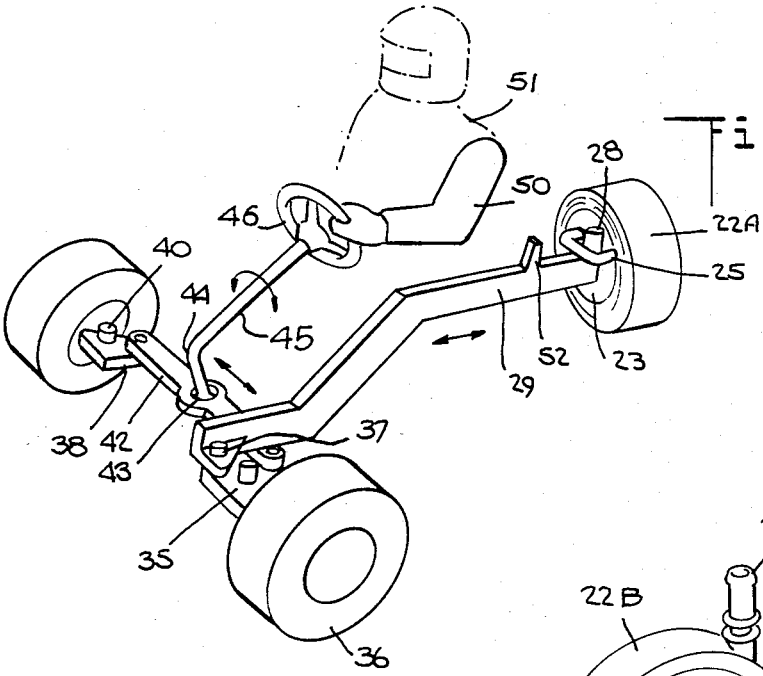
Fig. 6.
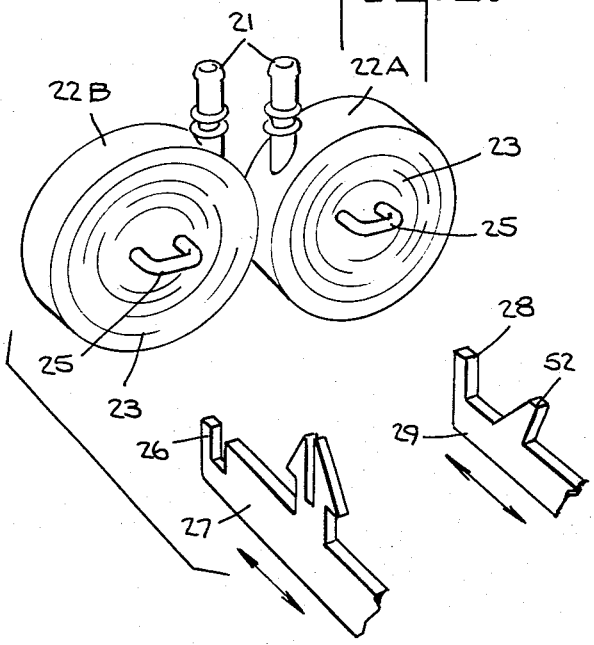
Fig. 5.
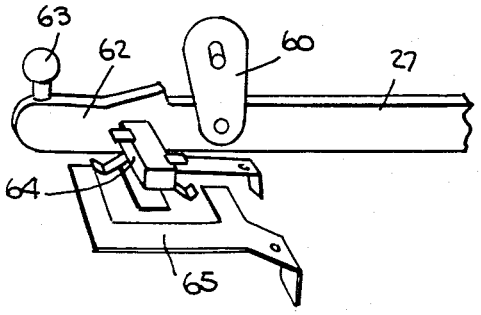
Fig. 8.
Fig. 7.
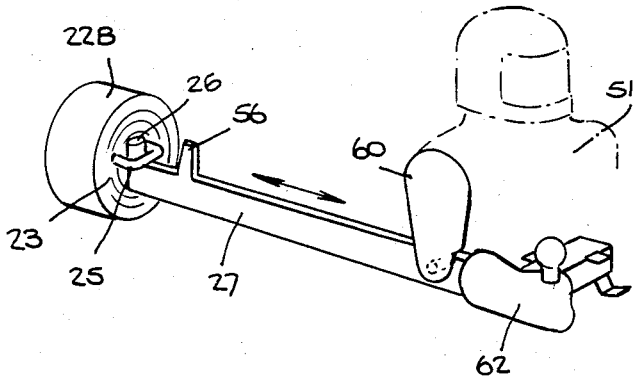

REMOTELY-CONTROLLED TOY VEHICLE

BACKGROUND OF INVENTION

Field of the Invention

This invention relates generally to steerable toy vehicles driven by a battery-powered d-c motor, and in particular to a toy of this type which is remotely controlled by means of a handset linked through a flexible pneumatic line to the motor control switch and the steering mechanism of the vehicle by a master-slave pneumatic system whereby the player holding the handset is able to control the direction of travel as well as to steer the vehicle.

It is known to control a d-c motor driven vehicle through a hand-held unit containing batteries and switches which are connected by a flexible tether cable to the vehicle. This arrangement has practical drawbacks; for the control unit which houses the batteries and switches is fairly heavy. Consequently, a child playing with the unit may drop it, with possible switch breakage or damage to the batteries.

In order to avoid the need to house electrical components in the control unit, the Masuda U.S. Pat. No. 3,671,694, discloses a light-weight control unit for a battery-powered toy vehicle provided with a manually-operated master bellows. The master bellows is pneumatically coupled through a flexible pipe to a slave bellows in the vehicle, such that manual compression of the master bellows by the player produces a flow of pressurized air causing expansion of the slave bellows, the reverse action taking place when the master is expanded.

In the Masuda arrangement, the slave bellows is operatively coupled to both the steering mechanism of the vehicle and to the motor-control switch which in one position causes the motor to drive the vehicle in the forward direction, and in another to drive the vehicle in reverse. This bellows is provided with a stop to limit its expansion to a predetermined range, control of the motor switch being effected when the bellows is operated within this range. Steering is effected only when the bellows is operated beyond this predetermined range.

In the Okuma U.S. Pat. No. 3,545,125, steering and motor control of a vehicle is carried out by a control unit having a master bellows therein coupled by a flexible pipe both to a motor-control slave bellows in the vehicle and a steering-control slave bellows therein, a valve acting to regulate the distribution of air between the two slave bellows.

In both the Masuda and Okuma patents, the player holding the control unit effects steering or motor control by applying pressure to a manual bellows actuator, this manual operation in dynamic terms being unrelated to the direction of steering or travel. Lacking, therefore, is the play satisfaction one gains by a rudder-like steering operation in which the direction of vehicle movement depends on the direction of rudder movement so that the child is then in the role of a pilot or driver, and by a gear shift operation which determines whether the vehicle travels in forward or reverse.

Also of background interest are the patents to Jackson, Pat. No. 2,638,712; Puckett, Pat. No. 2,795,668; Bunting, Pat. No. 2,668,821 and Hauge, Pat. No. 2,940,217.

SUMMARY OF INVENTION

In view of the foregoing, the main object of this invention is to provide a remotely-controlled toy vehicle in which a player holding a handset is able, through a master-slave pneumatic system, to both steer the vehicle and to control its direction of travel in a manner whereby the manual operations of the player are physically correlated to the actions of an actual driver.

More specifically, an object of the invention is to provide a remotely-controlled toy vehicle whose miniature driver has articulated arms, one of which appears to be turning the steering wheel and the other to be operating the gearshift lever, the player holding the handset controlling these actions so that the player assumes the role of the driver.

Also an object of this invention is to provide a motor-driven toy of the above type which may be operated by the player directly as well as remotely.

Still another object of this invention is to provide a toy which is of relatively simple design and which operates efficiently and reliably.

Briefly stated, these objects are attained in a remotely-controlled toy vehicle having a steering mechanism and driven by a dc motor selectively connected to a battery by a multi-position switch in a polarity which causes forward or reverse movement. Remote control is effected by a handset having first and second master diaphragm chambers linked through a flexible pneumatic line to first and second slave diaphragm chambers in the vehicle, one slave being operatively coupled to the steering mechanism and the other to the motor control switch. The handset is provided with a torsion bar having a handle, the bar being both swingable from side to side and also being rotatable. The bar is so coupled to the diaphragms of the master chambers whereby when the player swings the bar toward the left or right, this movement is pneumatically transmitted to the steering mechanism of the vehicle to cause the vehicle to turn toward the left or right. When the player rotates the bar clockwise or counterclockwise, this movement is pneumatically transmitted to the switch to cause the vehicle to travel in the forward or reverse direction.

OUTLINE OF DRAWINGS

For a better understanding of the invention as well as other objects and further features thereof, reference is made to the following detailed description to be read in conjunction with the accompanying drawings, wherein:

FIG. 5 shows, in perspective, the slave and diaphragm chambers, and how they are linked to the drive switch actuator bar and to the steering actuator bar of the vehicle;

FIG. 6 illustrates the steering mechanism of the vehicle and its relationship to one hand of the driver;

FIG. 7 illustrates the drive switch actuator bar and its relationship to the other hand of the driver; and FIG. 8 shows the drive switch actuator bar in conjunction with the switch operated thereby.

DESCRIPTION OF INVENTION

Figure 1:
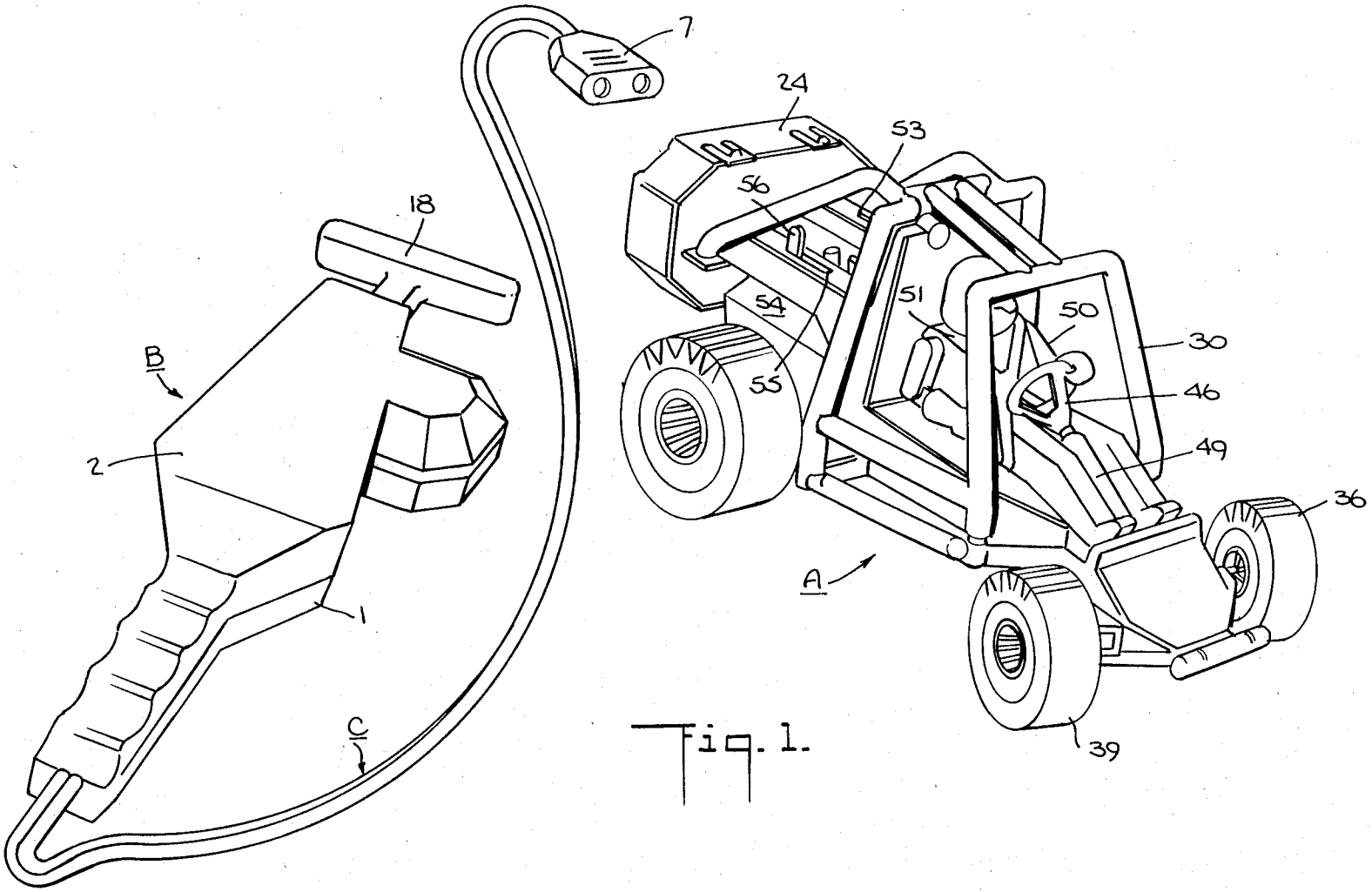
FIG. 1 is a perspective view of a remotely-controlled, battery-operated toy vehicle in accordance with the invention, the pneumatic cable from the handset being shown disconnected from the vehicle.

Referring now to FIG. 1, there is shown a four-wheel toy vehicle of the racing type having a helmeted miniature racing driver therein, the vehicle being generally designated by letter A. This vehicle is remotely controlled by a player holding a handset B which is linked to the vehicle by a pneumatic line C terminating in a female connector adapted to be coupled to plugs projecting from the rear trunk of the vehicle.

The vehicle is operated by a battery-energized miniature d-c motor and includes a steering mechanism. The remote control arrangement is such that the player manipulating a single handle can selectively control the polarity of battery voltage applied to the motor, and thereby determine the direction of travel (i.e., forward or reverse). The player can at the same time also steer the vehicle toward the left or right.

Figures 2, 3, 4:
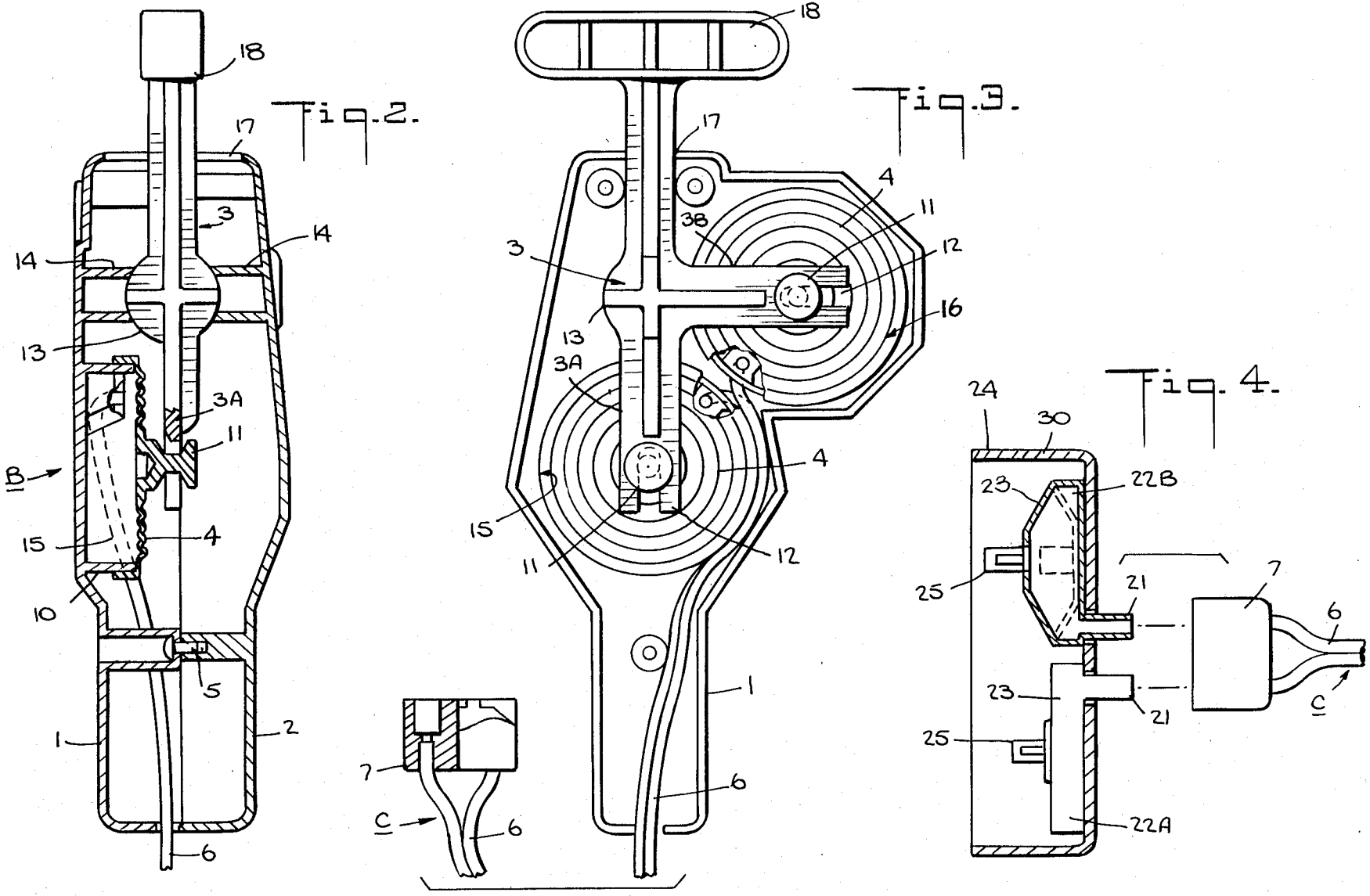
FIG. 2 is a longitudinal section taken through the handset.
FIG. 3 is a plan view of the handset with its front section removed to expose the working components.
FIG. 4 illustrates, in section, the trunk of the vehicle which houses the two slave diaphragm chambers that are coupled to the master chambers in the handset, one slave chamber being cut away to show the diaphragm in its expanded position and also (in dotted lines) in its retracted or contracted position.

As shown in FIGS. 2 and 3, handset B includes a molded case formed by complementary rear and front sections 1 and 2 held together by screws 5 to define a hollow internal cavity. Formed on the inner face of rear section 1 and integral therewith are two circular shells to define first and second master diaphragm chambers 15 and 16. Each chamber is covered and sealed by a flexible diaphragm 4 which is peripherally bonded to the shell, as by sonic welding. Each diaphragm 4 is provided on its outer face with a headed stud 11 that lies within a respective slot 12 in a torsion bar 3. One slot 12 is cut in the end section 3A of bar 3, the other slot being cut in the end of a side arm 3B extending laterally from about the midpoint of bar 3.

Bar 3 and its side arm 3B are provided with reinforcing ribs. The junction of side arm 3B and bar 3 is formed into a spheroidal bearing 13 which is captured between a pair of spigots 14 formed in the rear and front sections of the case, as shown in FIG. 2.

Bar 3 projects through a guide slot 17 formed at the end of the handset case and terminates in a handle 18. Because of guide slot 17, one may, by holding handle 18, swing bar 3 about bearing 13 from the left to the right, or vice versa, to an extent determined by the limits of the slot, and thereby cause end section 3A of the bar to displace diaphragm 4 of the first diaphragm chamber 15 inwardly or outwardly with respect to its neutral position.

One can also twist handle 18 in the clockwise or counterclockwise direction, and thereby rotate torsion bar 3 in its bearing to cause side arm 3B to displace diaphragm 4 of the second diaphragm chamber 16 inwardly or outwardly with respect to the neutral position of this diaphragm.

The first and second master diaphragm chambers 15 and 16, which are hermetically sealed, communicate with the respective parallel flexible pipes 6 of the pneumatic cable C, so that when the diaphragm in the related master chamber is inwardly displaced, this results in the forward flow of air in the pipe 6 under positive pressure. When the displacement is outward, this results in the reverse flow of air in the pipe under negative pressure or suction.

As best seen in FIG. 4, disposed within a trunk 24 on the rear of vehicle A are first and second slave diaphragm chambers 22A and 22B, each formed by a can of rigid material covered and sealed by a flexible diaphragm 23 which is displaceable inwardly or outwardly on either side of a neutral position. Each slave diaphragm chamber (22A and 22B) communicates with a coupling plug 21 that projects from the rear of trunk 24.

The parallel flexible pipes 6 of pneumatic line C terminate in a female connector 7. As shown in FIG. 4, this connector can be push fit into the pair of plugs 21, thereby pneumatically coupling the first and second master diaphragm chambers 15 and 16, respectively, to slave diaphragm chambers 22A and 22B.

Thus master diaphragm chambers 15 and 16, which are operatively linked through air pipes 6 to slave chambers 22A and 22B when the female connector 7 is coupled to plug connectors 21, form a closed pneumatic system. In this system, the displacement of the diaphragm 4 in a master chamber inwards or outwards with respect to its neutral position gives rise to a positive or negative pressure (suction) in the trapped body of air to bring about a corresponding displacement in the diaphragm 23 of the associated slave chamber.

The outer face of each slave diaphragm 23 is provided with a U-shaped yoke 25 which in practice may be molded thereto. Yoke 25 of the second slave 22B is engaged by the upstanding finger 26 at the end of an actuator bar 27 coupled to the motor control switch of the vehicle. Yoke 25 of the first slave 22A is engaged by the finger 28 of a steering bar 29 which operates the steering mechanism of the vehicle.

As best seen in FIG. 1, the steerable vehicle A is provided with a front roll bar 30 to protect the driver 51, the vehicle having a miniature d-c motor (not shown) powered from batteries located in a battery compartment. The first master diaphragm chamber 15 effects by way of the first slave diaphragm chamber 22A a steering movement when control bar 3 is swung to the left or right in its bearing 13. The second master diaphragm chamber 16 effects by way of the second slave diaphragm chamber 23B forward or reverse drive, this slave operating a three-position motor control switch in which the neutral "off" position disconnects the batteries from the motor, the other two positions providing forward and reverse travel, depending on the polarity of the voltage applied to the motor.

The use of a diaphragm chamber that is rigid save for the movable diaphragm is advantageous compared to a bellows structure. The diaphragm's neutral position which corresponds to ambient pressure also represents, in the case of the associated steering mechanism, a straight ahead steering position, whereas the flow of air as a result of diaphragm compression or expansion relative to the neutral position in response to a left or right movement of the torsion bar 3 causes the steerable axle for the vehicle to make a left or right turn to an extent depending on the extent to which the torsion bar is swung by the player.

Thus the player who holds the handset and manipulates the handle of the torsion bar, operates the handle in the manner of a rudder, thereby giving the player a realistic sense of vehicle control. And when the player twists the handle, the resultant action, as will be explained later in greater detail, simulates the action of a gear shift lever from a neutral position to a forward or reverse position.

As shown in FIG. 6, steering bar 29, which is operatively linked at one end to slave diaphragm chamber 22A, is pivotally connected at its other end to the steering arm 35 of the steering mechanism, this arm supporting the left hand front wheel 36. At the upper face of arm 35 is a spigot 37 that is received in a socket in the body of the vehicle, the spigot serving as a pivot for the steering arm. A second steering arm 38 which supports the right hand wheel 39 is provided with a pivoting spigot 40 that is received in another socket in the body of the vehicle.

Steering arms 35 and 38 are interlinked by a track rod 42 whereby reciprocal movement of steering bar 29 in response to a displacement of the diaphragm 25 of the slave chamber 22A causes left wheel 36 to shift, this steering movement being transmitted to right wheel 39 by the track rod.

Track rod 42 is formed with a central aperture 43 which receives the end of a crank arm 44 placed at the lower extremity of the shaft 45 of a steering wheel 46. Shaft 45 is supported in a journal bearing 49 (see FIG. 1) in the body 54 of the car whereby movement of the track rod brings about a corresponding steering movement of steering wheel 46.

The left arm 50 of driver 51 is pivoted to the driver's body and is connected to wheel 46. As a consequence, a steering movement in response to the action of the player holding the handset and swinging the actuator bar 3 to one side or another, appear to originate from the left arm of the miniature driver, thereby giving the impression that it is the driver who is in control of steering.

An upstanding hand lever 52 on the steering bar 29 projects through a slot 53 located at the rear of the vehicle (see FIG. 1), so that when the remote control unit is disconnected from the vehicle, one can effect steering directly by operating hand lever 52 to reciprocate the steering actuator bar 29.

The motor control mechanism is shown in FIGS. 7 and 8. It will be seen that the motor control actuator bar 27 is provided with a finger 56 that projects through a slot 55 in the body 54 of the car so that direct motor control may be effected when the remote control unit is disconnected. Motor control bar 27 is pivotally connected to the right arm 60 articulated to the body 51 of the driver, and has at its extremity a model hand 62 gripping a model gear shift lever 63.

The concealed face of hand 62 carries the moving contact assembly 64 of a three-position motor control switch. Assembly 64 traverses the fixed contacts 65 of this switch as actuator bar 27 is shifted by slave chamber 22B under the control of the torsion bar on the handset when this bar is twisted in the clockwise or counterclockwise direction.

Thus when torsion bar 3 is untwisted, the switch is then in neutral and the motor is de-energized. When bar 3 is twisted in the clockwise direction, a fixed contact is engaged to apply the battery voltage to the motor in a polarity causing forward travel of the car, and when the bar is twisted in the counterclockwise direction, another fixed contact is engaged to reverse the polarity of the applied voltage to cause reverse travel of the car.

As the vehicle drive is switched from neutral to forward or reverse, the driver's arm 60 which engages the gear shift lever 63 appears to make corresponding gear shift movements, thereby imparting greater realism to the operation.

While there has been shown and described a preferred embodiment of a remotely-controlled toy vehicle in accordance with the invention, it will be appreciated that many changes and modifications may be made therein without, however, departing from the essential spirit thereof.

We claim:

1. A remote control system for a toy vehicle having a steering mechanism and a d-c motor for driving the vehicle, the motor being connected to a battery through a three-position switch having a neutral position, a forward travel position in which the battery voltage is applied to the motor in one polarity, and a reverse travel position in which the battery voltage is applied to the motor in the opposite polarity, said system comprising:

A. a handset provided with first and second master diaphragm chambers and a handle-operated torsion bar so coupled to the master chamber that when the torsion bar is shifted by its handle from side to side, the first master chamber is either compressed or expanded; and when the torsion bar is twisted by its handle clockwise or counterclockwise, the second chamber is either compressed or expanded, said torsion bar being provided at its end with a slot that is slidably engaged by a stud projecting from the diaphragm of the first master chamber, said bar having a side arm provided at its end with a slot that is slidably engaged by a stud projecting from the diaphragm of the second master chamber;

B. first and second slave diaphragm chambers disposed in said vehicle, the first slave chamber being operatively coupled to said steering mechanism to cause steering in a direction that depends on whether this chamber is compressed or expanded, said second slave chamber being operatively coupled to said switch to cause said switch to assume said forward or reverse position depending on whether this chamber is compressed or expanded; and C. a pneumatic tether line coupling said first and second handset master chambers to the first and second slave chambers, said line being formed by a pair of flexible pipes.

2. A system as set forth in claim 1, wherein said line from the master chambers terminates in a female connector, and said slave chambers are provided with plugs which push fit into said connector.

3. A system as set forth in claim 1, wherein said master and slave chambers are defined by rigid cylindrical cans covered and sealed by a flexible diaphragm.

4. A system as set forth in claim 1, wherein said first slave diaphragm is operatively linked to the steering mechanism by an actuator bar having an upstanding finger that projects through a slot in the body of the vehicle for direct manual steering when the line is disconnected.

5. A system as set forth in claim 4, wherein said second slave diaphragm is operatively linked to the switch by an actuator bar having an upstanding finger that projects through a slot in the body of a vehicle for direct normal motor control when the line is disconnected.

6. A system as set forth in claim 5, further including a miniature driver in said vehicle having articulated right and left arms, one arm having a hand holding onto a gear shift lever coupled to the actuator bar for the switch so that this arm moves when the switch is operated, the other arm having a hand holding onto a steering wheel coupled to the steering mechanism, the wheel turning when the mechanism is operated to cause the hand thereon to appear to cause the turning.

* * * * *